US005309857A

United States Patent [19]

Brosseuk

[11] Patent Number: 5,309,857

[45] Date of Patent: May 10, 1994

[54] APPARATUS FOR TRANSFERRING BUOYANCY IN A NAUTICAL VESSEL

[76] Inventor: Raymond Brosseuk, Box 389, Bevelstoke, B.C. V0E 2S0, Canada

[21] Appl. No.: 852,111

[22] Filed: Mar. 16, 1992

[51] Int. Cl.[5] ..... B63B 39/03

[52] U.S. Cl. ..... 114/125; 114/140

[58] Field of Search ..... 114/140, 121, 122, 125

[56] References Cited

U.S. PATENT DOCUMENTS

| | | | |
|---|---|---|---|
| 3,604,386 | 9/1971 | Turci | 114/125 |
| 3,741,145 | 6/1973 | Braddon | 114/125 |
| 4,541,356 | 9/1985 | Jones | 114/61 |

FOREIGN PATENT DOCUMENTS

| | | | |
|---|---|---|---|
| 2219973 | 12/1989 | United Kingdom | 114/125 |

*Primary Examiner*—Sherman Basinger
*Attorney, Agent, or Firm*—Charles H. Thomas

[57] ABSTRACT

An apparatus is provided for reducing the extent of heel of a nautical vessel by applying a buoyant righting moment on the leeward side of a hull of the vessel. Supports are coupled to and extend laterally beneath the hull and carry hollow bulbs on their extremities. The bulbs on both sides of the vessel are each divided by fore and aft partitions into inboard and outboard chambers. A passage is defined between the inboard chambers and a separate passage is defined between the outboard chambers. A first fluid fills the outboard chambers and the passage therebetween, while a second fluid having a specific gravity different than that of the first fluid fills, the inboard, chambers and the passageway therebetween. A sensor and actuator responsive to heel of the hull selectively shifts a portion of the first fluid from the outboard chamber of a first one of the bulbs to the outboard chamber of the other of the bulbs and concurrently shifts a portion of the second fluid from the inboard chamber of the other bulb to the inboard chamber of the first bulb. A buoyant fluid, such as air, can thereby be shifted to an outboard chamber beneath the leeward side of a heeling vessel to exert a righting moment to counter the heeling force of the wind.

21 Claims, 4 Drawing Sheets

APPARATUS FOR TRANSFERRING BUOYANCY IN A NAUTICAL VESSEL

BACKGROUND OF THE INVENTION

1. Field of the Invention

The present invention relates to a system for shifting buoyancy to leeward in a nautical vessel to increase righting moment and reduce heel.

2. Description of the Prior Art

Nautical vessels adapted for propulsion through the water all respond to transverse components of the force of the wind by heeling. In the case of a sailing vessel which is propelled forward by the force of wind the effects of heeling have a considerable impact on the speed with which the vessel can travel under any given wind conditions, as well as the extent to which the vessel can point into the wind.

Conventional sailing vessels may have either a monohull or a multiple hull configuration. A monohull sailing vessel has a single, elongated hull which is narrowest at the bow, broadens amidships, and narrows somewhat at the stern. The surface of the hull is streamlined so as to minimize water resistance as the hull travels through the water.

Monohull sailing vessels invariably employ some type of keel. The keel of most modern sailing vessels is formed as a thin, relatively narrow slab-like structure, which is streamlined at its fore and aft edges, and which extends downwardly from the bottom of the hull at some location amidship. The keel is formed of some heavy material, such as steel or lead.

The keel performs several important functions. Because a keel is relatively broad in a fore and aft direction, it presents a very large surface area perpendicular to the direction of forward travel of the vessel. The keel thereby offers considerable resistance to the transverse components of the wind and wave forces acting normal to the desired direction of travel of the vessel. The relatively large resistance to transverse or lateral motion by the keel limits the extent to which the vessel is pushed sideways in the water perpendicular to its intended direction of travel.

The keel also performs an extremely important function by providing ballast which creates a righting moment. This moment varies depending upon the extent to which a vessel is tilted by the transverse or lateral component of wind acting against the sails of the vessel. The force component of the wind in the sails acting perpendicular to the fore and aft alignment of the hull cause the vessel to tilt or cant to one side. This is termed heeling. Since the water resists sideways movement of the hull, the top of the vessel will tilt or heel at an incline away from the direction of the wind. The force of the wind acting normal to the desired direction of travel of the vessel thereby creates a moment which, if unopposed, could force the masts of the vessel into the water and capsize the vessel. However, when the top of the mast of a vessel is pushed to the direction toward which the wind is moving, which is the leeward direction, the rotational moment exerted on the hull causes the keel to rise upward in the water on the windward side of the hull.

Due to its very large weight, the keel of the vessel counters the heeling force of the wind by exerting an opposing moment on the vessel in a direction opposite to that exerted by the transverse component of the wind. The more powerful the force of the wind, the greater will be the heeling force on the vessel and the more the keel will rise closer to the horizontal. As the keel rises its moment arm or lever arm for the ballast it contains increases, thereby increasing the righting moment which the keel exerts on the vessel. Conversely, as the vessel heels the extent to which the transverse component of the wind acts normal to the sails is reduced. The vessel therefore reaches some equilibrium angle of heel at which the transverse moment exerted on the upper portion of the vessel by the wind is countered by an opposing transverse moment exerted on the lower portion of the vessel by the keel.

A sailing vessel operates most efficiently when it is heeled to somewhat. However, if the vessel heels to severely, it will spill the wind, thus reducing the driving force of the sails and reducing the speed with which the vessel is propelled through the water. The optimum extent of heeling varies from one vessel to another, but for monohull sailing vessels the optimum angel of heel is typically between about 10 degrees and 25 degrees from the vertical. Most sailing vessels do not operate efficiently in traveling at an angle to the wind if they heel less than about 8 degrees or greater than about 30 degrees.

While sailors can reduce heeling by reducing the sail area carried aloft, speed is inevitably sacrificed since the wind strength invariably lightens intermittently and momentarily. Therefore, when the sail area carried aloft is optimum for an average wind speed, momentary lulls in the wind detract from the driving force of the sails. Sailors therefore tend to carry enough sail area aloft to take advantage of momentary gusts of wind. With conventional sailing vessel designs there is therefore a continuous, recurring problem of excessive heeling, especially in gusty, heavy wind conditions.

SUMMARY OF THE INVENTION

A primary object of the present invention is to provide a nautical vessel with a system for reducing the extent of heeling of the vessel in the water. By reducing the heel of the vessel the sails are able to make use of the driving force of the wind to propel the vessel forward. In contrast, if the vessel heels excessively the force of the wind is merely expended in pushing the sails down toward the water, rather than propelling the vessel.

The conventional approach to reducing excessive heeling of a nautical vessel is to attempt to shift ballast above the waterline as the vessel heels. For example, when a vessel begins to heel excessively, the crew normally will move from the center or leeward side of the hull to the windward side, thus adding the righting moment produced by the weight of their bodies to the righting moment of the keel. A shifting of ballast is normally practical only above the waterline.

In contrast, according to the system of the present invention a reduction in heeling is not achieved by a transfer of ballast, but rather by a transfer of buoyancy. According to the system of the invention a fluid having a specific gravity less than the water in which the vessel sails is transferred between bulbs or containers located beneath the hull of the vessel on either side thereof. As the vessel begins to heel, the lighter fluid is forced into the bulb or container located beneath the leeward side of the vessel. This produces a righting moment which acts on the hull of the vessel to oppose the heeling force exerted by the wind.

Another object of the invention is to provide a system for increasing the righting moment on a vessel to reduce excessive heeling with only a slight or no increase in drag. While the provision of bulbs or containers holding a buoyant fluid below the waterline of a vessel may produce a slight increase in drag, the effects of the possible increased drag are more than offset by the enhanced propelling force produced in the sails by avoiding excessive heeling.

Still another object of the present invention is to produce a system which applies a righting moment to a nautical vessel by decreasing, rather than increasing the amount of ballast. Since a righting moment is achieved according to the invention through the use of enhanced buoyancy below the waterline, the amount of ballast required is reduced. The reduction of ballast reduces the overall weight of the vessel. By reducing weight, less surface area of the hull is in contact with the water. This reduces the drag on the hull, thereby increasing the speed of the vessel.

Still another object of the invention is to provide a nautical vessel with a system which not only generates a righting moment, but which also reduces the draft of the vessel. The draft of the vessel is the distance from the waterline to the lowest part of the vessel, which is the bottom of the keel. A reduction in draft is possible because the depth of the keel can be reduced, since less of a righting moment is required from the ballast of the keel as a result of the provision of buoyant compartments beneath the waterline.

In a conventional nautical vessel the ballast of the keel acts at a moment arm that increases with the depth of the keel. Therefore, the deeper the keel the greater will be the righting moment produced by the ballast of the keel. However, a deeper keel requires the vessel to have a greater draft, which creates difficulties in moving and in passing through channels. By employing buoyant bulbs or pods beneath the waterline of the vessel, the keel depth can be reduced without a loss of righting moment. This allows the vessel to have a shallower draft. The vessel can therefore be more easily moved and is provided with access to shallower anchorages which deeper keeled vessels cannot enter.

A further object of the invention is to enhance the comfort of a nautical vessel by reducing the extent of heel. When a nautical vessel heels excessively the decks of the vessel are tilted from the horizontal to relatively steep angles. The passengers and crew of the vessel therefore have a difficult time in maintaining their balance and in remaining upright as the vessel travels through the water. By reducing the heeling of the vessel the comfort of the passengers and crew is enhanced without any loss in sailing efficiency.

Yet another object of the invention is to allow a nautical vessel to sail with more sail area aloft under given wind conditions without being subject to excessive heeling. By enhancing the sail area which is carried without the disadvantage of excessive heeling, the force of the wind in the sails is utilized more fully to propel the vessel at a greater speed than would otherwise be possible.

In one broad aspect the present invention may be considered to be apparatus for reducing the extent of heel of a nautical vessel having a hull extending in a fore and aft direction. The apparatus is comprised of supports coupled to and extending laterally beneath the hull and terminating in extremities laterally equidistant from the hull on opposite sides thereof. Hollow bulbs are located on the extremities of the supports. The apparatus of the invention also includes fluid tight dividing means in each of the bulbs to divide each of the bulbs in a fore and aft direction into inboard and outboard chambers. Means are provided for defining a passage between the inboard chambers and also for defining a separate passage between the outboard chambers. A first fluid fills the outboard compartments and the passage therebetween, while a second fluid having a specific gravity different than that of the first fluid fills the inboard compartments and the passageway therebetween. A fluid transfer means is operable to selectively shift a portion of the first fluid from the outboard compartment of a first one of the bulbs to the outboard compartment of the other of the bulbs, and concurrently shift a portion of the second fluid from the inboard compartment of the other of the bulbs to the inboard compartment of the first one of the bulbs.

In a preferred construction of the invention, the specific gravity of the second fluid is greater than that of the first fluid. The first fluid is preferably air and the second fluid may be seawater. In such an embodiment the fluid transfer means shifts the lighter fluid, namely the air from the outboard compartment of the windward bulb to the outboard compartment of the leeward bulb when the vessel heels. Concurrently, a portion of the seawater is shifted from the inboard compartment of the leeward bulb to the inboard compartment of the windward bulb. The net result is a shift in buoyant effect from the windward to the leeward bulb. When the vessel is heeled, any buoyant effect of the windward bulb tends to increase heeling. However, by shifting the buoyant fluid from the windward to the leeward bulb, the righting moment produced by the buoyant fluid in the leeward bulb is substantially increased, while the buoyant effect from the windward bulb is substantially reduced. The transfer of seawater is not actually a concurrent shift of ballast, since technically speaking the seawater cannot be considered to be ballast, because its specific gravity is no different than that of the seawater in which the vessel floats.

In another broad aspect the invention may be considered to be an improvement in a nautical vessel extending fore and aft and having a hull. The improvement is comprised of a support means that is coupled to the hull and projects laterally outwardly therebeneath on opposite sides thereof. The support means carries a pair of hollow bulbs. A means is provided for dividing each of the bulbs fore and aft into inboard and outboard mutually fluid tight compartments. Means are also provided for defining a passageway between the inboard compartments and a separate passageway between the outboard compartments. A first fluid fills the outboard compartments and the passageway therebetween while a second fluid having a specific gravity different than that of the first fluid fills the inboard compartments and the passageway therebetween. A fluid transfer means is provided for concurrently increasing the volume of the inboard compartment of one of the bulbs while decreasing the volume of the inboard compartment of the other of the bulbs and for concurrently increasing the volume of the outboard compartment of the other of the bulbs while decreasing the volume of the outboard compartment of the first of the bulbs.

While in the preferred embodiment of the invention the second fluid has a greater specific gravity than the first fluid, the arrangement can be reversed. That is, the heavier fluid, such as water, can be located in the outboard compartments and the lighter fluid, such as air, can be located in the inboard compartments. In this arrangement the heavier fluid is transferred from the outboard compartment of the leeward bulb to the outboard compartment of the windward bulb, while the lighter fluid is concurrently transferred from the inboard compartment of the windward bulb to the inboard compartment of the of the leeward bulb. A righting moment that opposes heeling of the nautical vessel will be obtained in both cases. However, it is preferable for the lighter, buoyant fluid to be located in the outboard compartments since this maximizes the moment arm of the buoyant force, thereby producing an enhanced righting moment.

In another arrangement the bulbs are constructed of flexible, inflatable resilient materials on the ends of the support means. In this arrangement only a single buoyant fluid, such as air, is employed in the bulbs. As the vessel heels, air is pumped or forced from the windward to the leeward bulb thereby expanding the exterior surface of the leeward bulb and contracting the exterior surface of the windward bulb. This causes the volume of the cavity within the leeward bulb to increase while the volume of the cavity within the windward bulb shrinks. The righting moment resulting from the increased volume of buoyant fluid within the leeward bulb counters the heeling force of the wind. Also, the surfaces of the bulbs which are expanded and contracted can be fashioned so that the leeward bulb creates a hydrodynamic lift as it expands, thereby further opposing the heeling moment on the vessel produced by the forces of the wind.

Fluids other than air and water can be used to produce the required shift in buoyant force. The greater the difference in specific gravity of the fluids the greater will be the effects of shifting buoyant forces. For example, mercury can be used as a ballasting fluid to fill the inboard compartments with air as the fluid in the outboard compartments to achieve very large changes in buoyant effect.

The compartmentalized bulbs or containers which hold the fluids of differing specific gravity may be mounted to the hull in several different ways. In one preferred embodiment the vessel has a keel that extends downward centered on a plane that passes fore and aft through the center of the hull. The bulb supports and the keel thereby have an inverted "T-shaped" configuration in which the supports extend laterally outwardly from opposite sides of the keel. The bulbs are carried at the extremities of the laterally extending supports.

It is possible to locate the bulbs a distance apart even greater than the beam of the vessel. Indeed, with the bulbs located outboard of the gunwales of the hull, the moment arm with which the buoyant force acts to exert a righting moment is increased as the distance from the fore and aft plane of the hull increases. However, as a practical matter the bulbs should be maintained within the beam of the vessel so that they will not collide with piers, seawalls and other underwater obstructions which the hull can clear at the surface.

The lateral supports may extend outwardly from the keel generally perpendicular thereto. Also, they may extend downwardly and outwardly at an angle relative to the keel. Alternatively, they could even extend outwardly and upwardly at an incline relative to the keel.

In still a different configuration of the apparatus of the invention the keel can be formed in a hoop or loop, the sides of which are hollow and compartmentalized. In still another configuration the bulb supports may perform the function of a keel and extend in diverging fashion down from the center of the underside of the hull. In this arrangement the supports assume the configuration of a chevron having its apex at the underside of the hull and with the compartmentalized bulbs located at the lowest extremities of the supports. In still another configuration the supports can extend downwardly and outwardly from the underside of the hull. Numerous other support and bulb configurations are also possible to achieve different buoyancy characteristics at different heeling angles.

The fluid tight dividing means that delineate the compartments within the bulbs may assume several forms. Preferably, each of the bulbs is divided longitudinally in a fore and aft direction by a flexible diaphragm the periphery of which is sealed to the inside surface of the bulb throughout its perimeter. The volume of the inboard and outboard compartment within each bulb can thereby be increased or decreased by forcing the center of the diaphragm in either an inboard or an outboard direction.

Alternatively, each of the bulbs may be divided into compartments by a piston which can move laterally in reciprocal fashion within a cylindrical cavity within the bulb to define an outboard compartment of variable volume at the extremity of the cylinder remote from the center of the vessel and an inboard compartment at the extremity of the cylinder closest to the center of the vessel. A pair of pistons, coupled together by a hollow connecting tube will have the configuration of a dumbbell with a central passageway between the outboard compartments defined throughout its length. The pistons, locked together at a fixed distance apart by means of the hollow tube that serves as a piston rod, can then be moved laterally in a transverse direction beneath the hull of the vessel to vary the volumes of the inboard and outboard compartments which they define to thereby vary the direction of the buoyant moment produced.

In a preferred embodiment of the invention the means for defining the passage between the outboard chambers is comprised of a hollow inner tube extending between and joined to flexible diaphragms that delineate the inboard and outboard compartments of each bulb, and apertures in the diaphragms at the extremities of the hollow inner tube. The means for defining the passage between the inboard chambers is preferably comprised of a hollow outer tube disposed coaxially about the hollow inner tube and extending between and joined to the bulbs at openings on the inboard sides thereof. The fluid transfer means includes means for shifting the inner tube longitudinally relative to the outer tube, which is laterally relative to the hull of the vessel.

The mechanism for shifting the inner tube relative to the outer tube may be comprised of a rack defined on the outer surface of the inner tube, a pinion engaged with the rack and disposed generally in a horizontal plane, a motion transmission shaft extending from the pinion up into the hull, and gravity operated means coupled to the transmission shaft for rotating the transmission shaft in a selected direction responsive to the heel of the hull. Such a fluid transfer means is thereby operative automatically in response to heeling of the vessel.

The hull typically has a deck that extends generally parallel to the surface of the water when the vessel is not heeled and sits straight upright in the water. The gravity operated means may be comprised of a crank arm extending radially outwardly from the motion transmission shaft. A weighted roller may be coupled to the radial extremity of the crank arm. An arcuate track may be disposed parallel to the deck of the vessel. In this way the roller rolls to the leeward side of the track, thereby turning the motion transmission shaft in rotation by means of the crank arm.

The pinion at the lower extremity of the motion transmission shaft advances the rack laterally in a direction perpendicular to the plane of the fore and aft alignment of the vessel. The rack and reciprocal coupling tube to which it is attached are thus forced toward one of the bulbs and away from the other bulb to thereby alter the volume of the inboard and outboard chambers of each bulb in an inverse manner. That is, the rack is advanced toward a first one of the bulbs to push the center of the dividing diaphragm laterally outboard in that bulb, thereby reducing the volume of the outboard compartment and increasing the volume of the inboard compartment of that bulb. The opposite end of the coupling tube acts upon the center of the diaphragm of the other bulb to increase the volume of the outboard compartment and reduce the volume of inboard compartment of that other bulb.

The invention may be described with greater clarity and particularity by reference to the accompanying drawings.

DESCRIPTION OF THE EMBODIMENT

Figure 1:
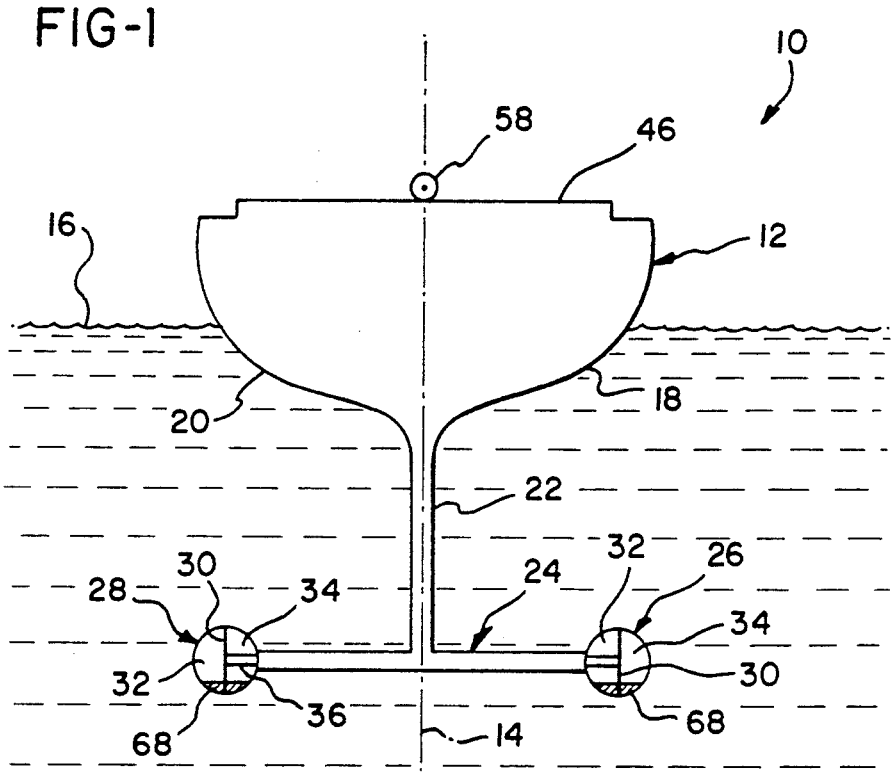
FIG. 1 is a rear, elevational diagram of an improved nautical vessel according to the invention shown at a zero degree heel.

FIG. 1 diagrammatically illustrates a floating nautical vessel indicated generally at 10 having a hull 12 which is symmetrical about a fore and aft plane indicated in dotted lines at 14. When the hull 12 is at a zero angle of heel relative to the surface of the water in which the vessel 10 floats, indicated at 16, the fore and aft plane 14 is vertical and passes lengthwise through the hull 12 from bow to stern. FIG. 1 may be considered to be a view looking straight onto the stern of the boat, so that the right hand or starboard side of the hull is indicated at 18 and the left hand or port side of the hull is indicated at 20. From the hull 12 a weighted keel 22 extends downwardly along the fore and aft plane 14. The hull 12 has a deck 46 that resides generally in a horizontal plane, parallel to the surface 16 of the water when the hull 12 is at a zero degree angle of heel, as depicted in FIG. 1.

The apparatus of the invention is an improvement to the floating vessel 10. The apparatus of the invention includes hollow container support means in the form of a hollow, cylindrical annular support tube 24 that is coupled to the hull 12 through the keel 22 and extends laterally beneath the hull 12 on both sides thereof. A pair of hollow containers or bulbs 26 and 28 are carried at the outboard extremities of the container support tube 24 beneath and on the opposite starboard and port sides 18 and 20, respectively of the hull 12.

Figure 3:
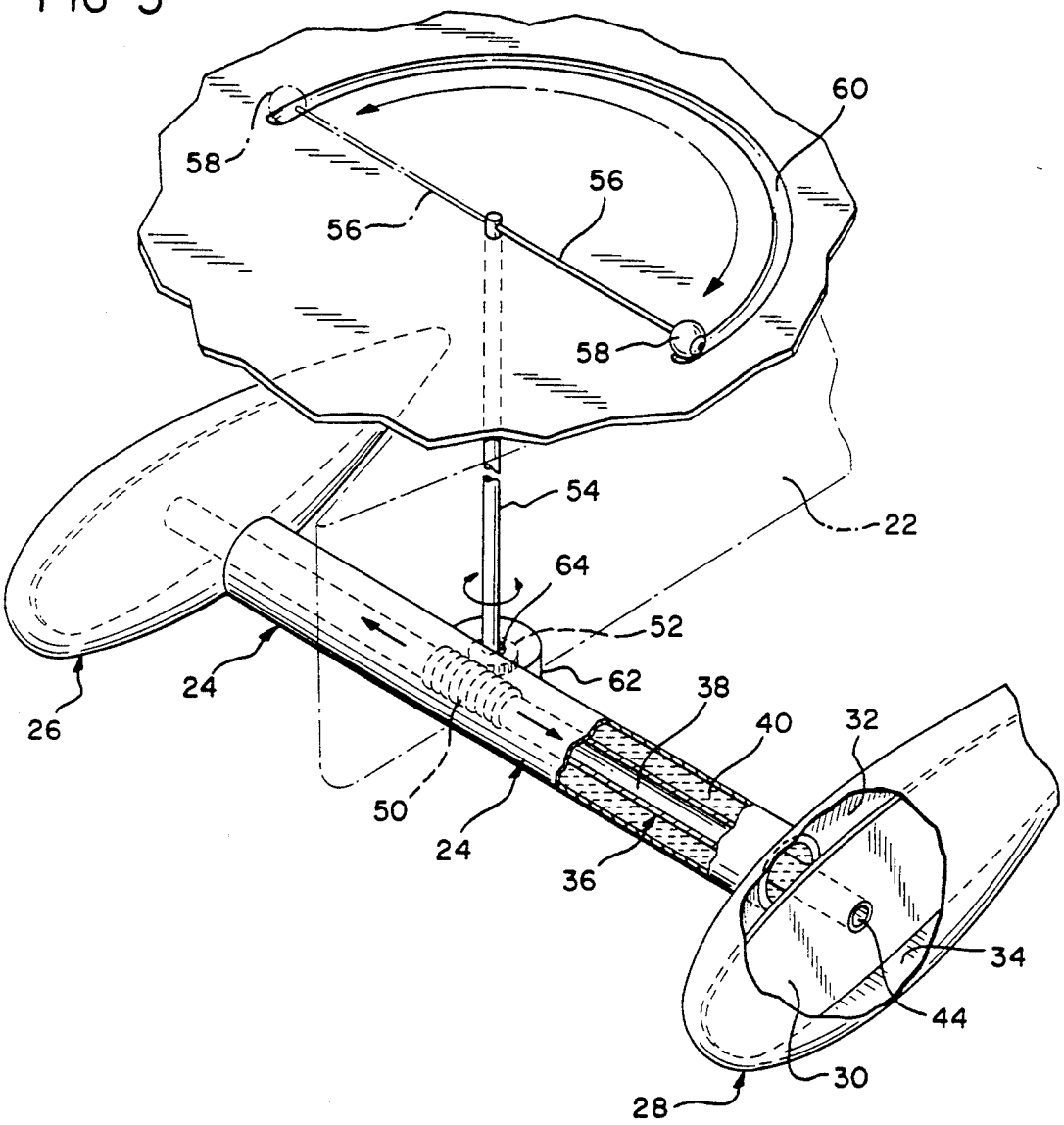
FIG. 3 is a perspective diagram of the apparatus of the invention for reducing the extent of heel of the nautical vessel shown in FIGS. 1 and 2.
Figure 4:
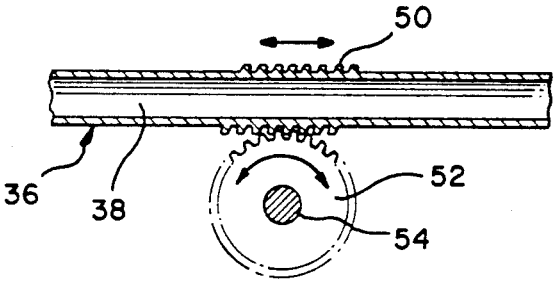
FIG. 4 is a top plan detail of the rack and pinion mechanism employed in the apparatus of FIG. 3.
Figure 5:
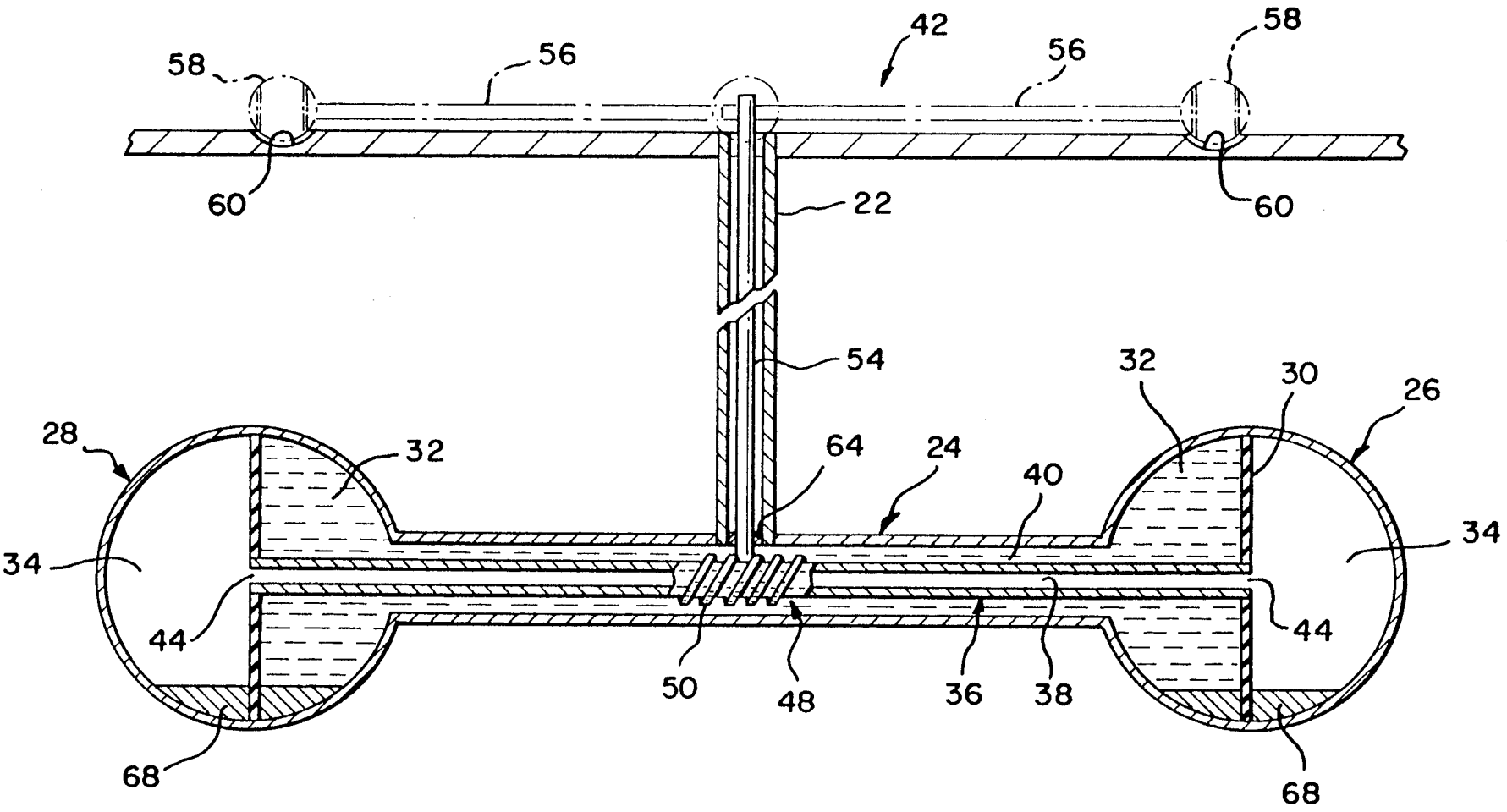
FIG. 5 is a sectional elevational view of the apparatus of FIG. 3 for reducing the extent of heel of a nautical vessel.

As best illustrated in FIGS. 3 and 5, each of the bulbs or containers 26 and 28 has a fluid tight divider in the form of a flexible rubber diaphragm 30 that divides each of the containers or bulbs 26 and 28 in a fore and aft direction, parallel to the fore and aft plane 14. Each diaphragm 30 defines an inboard cavity 32 and an outboard cavity 34 in the bulbs 26 and 28.

A rigid, hollow coupling means in the form of a cylindrical, annular coupling tube 36 is disposed for reciprocal movement within the hollow support tube 24. The coupling tube 36 defines an internal cylindrical flow passageway 38 therewithin in open communication between both of the outboard cavities or chambers 34 in the two bulbs 26 and 28. Between the outer surface of the hollow coupling tube 36 and the inner surface of the hollow container support 24 an annular external flow passageway 40 is defined. The inboard cavities 32 are thereby coupled in open communication with each other through the external flow passageway 40.

A first fluid, which preferably is air, fills the outboard cavities 34 and the internal passageway 38 extending therebetween. A second fluid, which preferably is seawater, has a different specific gravity than the first fluid and fills the inboard cavities 32 and the external passageway 40.

Figure 2:
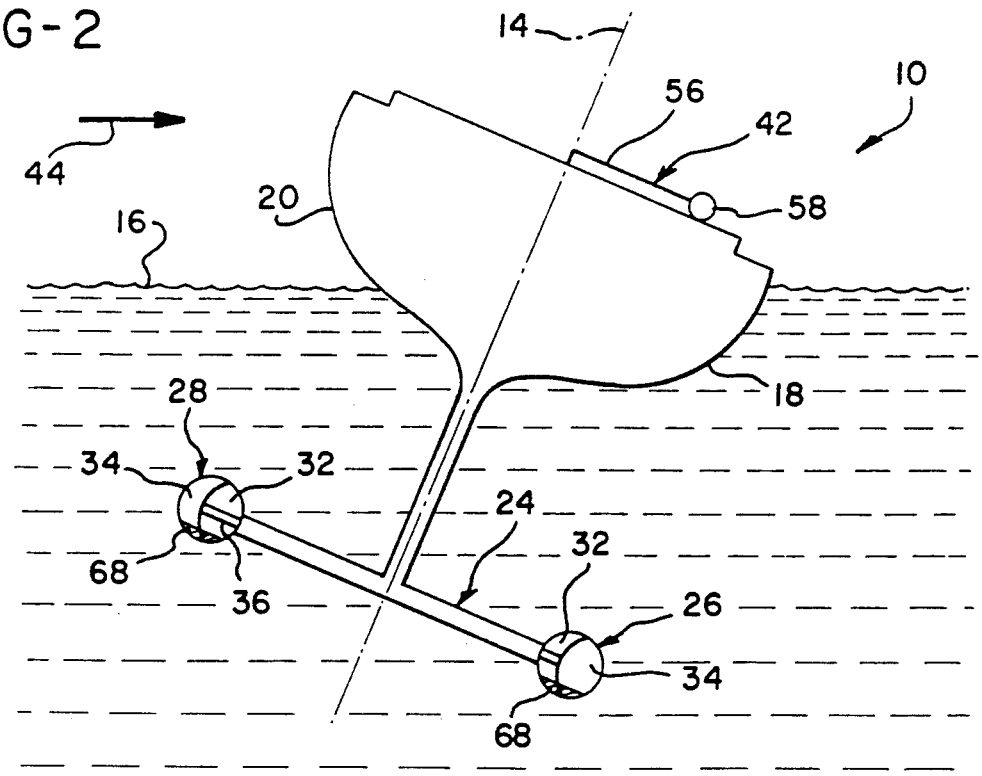
FIG. 2 is a diagram of the vessel of FIG. 1 shown heeled due to a wind force acting from the left.

The apparatus of the invention also includes an inclination sensing means 42 which is connected to the hollow coupling tube 36 to move the hollow coupling tube 36 laterally toward one of the bulbs or containers 26 or 28 in response to heeling of the hull 12 in a first lateral direction. As illustrated in FIG. 2, when the wind blows from the port side of the vessel 10 as indicated by the directional arrow 44, the hull 12 heels to starboard, so that the port side 20 of the hull 1 is the windward side and the starboard side 18 of the hull 12 is the leeward side. The inclination sensing mechanism 42 moves the hollow coupling tube 36 toward the hollow container or bulb 28 when the boat heels to starboard as depicted in FIG. 2. Conversely, the inclination sensing means 42 moves the hollow coupling tube 36 laterally toward the other container or bulb 26 in response to heeling of the hull 12 to port.

The movement of the hollow coupling tube adjusts the volumes of the cavities or chambers 32 and 34 to force the respective fluids in the chambers 32 and passageway 40 and in the chambers 34 and passageway 38 in opposite directions. The fluids move through their respective passageways so that the volume occupied by the buoyant fluid is increased on the leeward side of the hull 12. The buoyant fluid thereby exerts a righting moment on the hull 12.

As best illustrated in FIGS. 3 and 5, the containers or bulbs 26 and 28 both have apertures in their inboard sides that face each other. The diaphragms 30 both have apertures 44 therein that are aligned with the apertures in the bulbs or containers 26 and 28. The hollow inner tube 36 extends between and is sealed to the diaphragms 30 at its opposite ends at the apertures 44 in the diaphragms 30. The hollow outer tube 24 is disposed about the hollow inner tube 36 and extends between and is sealed to the bulbs or containers 26 and 28 at the inboard facing openings therein.

As illustrated in FIG. 3, the bulbs 26 and 28 are of a streamlined generally torpedo shaped configuration so as to minimize drag as much as possible in movement through the water. The bulbs 26 and 28 may be formed of stainless steel or plastic and are secured by welding or by fusion to the outboard extremities of the hollow container support tube 24 at the facing openings therein located on the inboard sides thereof. There is some ballast material indicated at 68 in FIG. 5 located at the bottom of each bulb 26 and 28. The ballast material 68 is preferably lead or stainless steel. The ballast material 68 performs the same function as ballast in a conventional keel.

The means for shifting the inner coupling tube 36 relative to the outer hollow container support tube 24 is indicated generally at 48. The shifting means 48 is comprised of a rack 50 that is defined on the outer surface of the inner coupling tube 36, and a pinion 52 that is meshed with the rack 50. The pinion 52 is keyed or otherwise rigidly secured to a motion transmission shaft 54 which extends from the pinion 52 up into the hull 12. At its center there is an opening in the wall of the hollow container support 24 so that the teeth of the pinion 52 can be engaged in the teeth of the rack 50 on the inner coupling tube 36. The container support tube 24 may be equipped with an integrally molded or an attached semi-cylindrical collar 62 which is sealed to the wall of the hollow support tube 24 and which has an opening at its top through which the transmission shaft 54 extends. A packing seal 64 prevents leakage of water from the passageway 40. The gravity operated means 42 is coupled to the transmission shaft 54 for automatically rotating the transmission shaft 54 in a selected direction responsive to heel of the hull 12.

The inclination sensing means 42 includes means for shifting the inner tube 36 relative to the outer container support tube 24. The inner coupling tube 36 is disposed coaxially relative to the transverse, hollow container support tube 24, so that the coupling tube 36 moves axially or longitudinally relative to the hollow support tube 24, and laterally or transversely relative to the hull 12.

The hull 12 has a deck 46. The gravity operated inclination sensing means 42 is comprised of a crank arm 56 that extends radially outwardly from the motion transmission shaft 54. The crank arm 56 is keyed or otherwise rigidly joined to the motion transmission shaft 54. A weighted roller 58 is coupled to the radial extremity of the crank arm 56. An arcuate track is defined in the deck 46 of the hull 12 and resides in a plane parallel thereto. When the vessel 10 heels, the roller 58 rolls to the leeward side of the track 60, thereby turning the motion transmission shaft 54 in rotation by means of the crank arm 56.

The operation of the improved sailing vessel 10, and the buoyancy shifting apparatus which it employs, can be described as follows. When the vessel is traveling directly downwind with no lateral component of wind acting against it, the hull 12 will have a zero angle of heel as depicted in FIG. 1. In this condition the reciprocal coupling tube 36 is centered relative to the fore and aft plane 14 and the keel 22 and the flexible diaphragms 30 reside in vertical planes parallel to the fore and aft plane 14. Under such conditions the air in the outboard compartments 34 in each of the bulbs 26 and 28 exerts buoyant forces on opposite sides of the hull 12. The volume of each outboard compartment 34 in the two bulbs 26 and 28 are equal to each other, so that the buoyant effect is equal on both sides of the hull 12. The net buoyancy moment acting on the hull 12 due to the buoyancy of the air in the outboard compartments 34 is therefore zero. However, because the buoyant forces both act upwardly on the hull 12 through the keel 22, there is a net upward, buoyant force on the vessel 10 that tends to lift the hull 12 slightly relative to the surface of the water 16. This has the benefit of reducing the surface area of the hull 12 that is under water, thereby reducing drag on the vessel 10 as it travels through the water.

When the vessel 10 is subjected to a laterally directed component of wind coming from the port side of the vessel 10, as indicated at 44 in FIG. 2, the vessel 10 will heel to starboard, as illustrated. When this happens the weighted roller 58 rolls in the arcuate track 60 from a position residing in the fore and aft plane 14 of FIG. 1 over to the starboard side of the vessel 10, as illustrated in FIG. 2. This occurs because the weighted roller 58 rolls along the track 60 toward the lowest point in the track 60, which is on the leeward starboard side 18.

As the weighted roller 58 travels, it rotates the upright transmission shaft 54 about the axis of the shaft 54 which resides in the fore and aft plane 14. Rotation of the transmission shaft 54 in a counter-clockwise direction, as viewed in FIG. 3, causes the pinion 52 to likewise rotate in a counter-clockwise direction. Due to the meshed engagement of the pinion 52 with the teeth of the rack 50, the hollow coupling tube 36 is thrust laterally toward the windward side of the hull 12, which is the port side 20 in FIG. 2.

Since the diaphragms 30 are sealed fluid tight to the extremities of the coupling tube 36, both diaphragms 30 are elastically deformed into an arcuately curved configuration, as illustrated in FIG. 2. As is evident from this drawing figure, by pressing the diaphragms 30 toward the port side 20, the volume within the outboard compartment 34 of the windward bulb 28 is reduced while the volume of the outboard compartment 34 of the leeward bulb 26 is increased. This causes a transfer of air from the outboard compartment 34 of the windward bulb 28 through the fluid passageway 38 and into the outboard compartment 34 of the leeward bulb 26.

Concurrently, and likewise due to the flexing of the resilient diaphragms 30 toward the port side 20 of the vessel 10, the volume of the inboard compartment 32 of the windward bulb 28 is increased while the volume of the inboard compartment 32 of the leeward bulb 26 is reduced. This causes water to be displaced from the inboard compartment 32 of the leeward bulb 26 through the annular passage 40 and into the inboard compartment 32 of the windward bulb 28.

As a result of the movement of the fluids between the bulbs 26 and 28, the volume of the outboard compartment 34 containing air within the leeward bulb 26 increases, while the opposite is true of the outboard compartment 34 of the windward bulb 28. This means that there is more air in the outboard compartment 34 of the bulb 26 than there is in the outboard compartment 34 of the bulb 28. In the embodiment depicted the outboard compartment 34 of the bulb 26 occupies about two thirds of the total volume of the cavity within that bulb while the outboard compartment 34 of the bulb 28 occupies only about one third of the total volume of the cavity within that bulb. Conversely, there is a greater volume of water within the inboard compartment 32 of the windward bulb 28 than within the inboard compartment 32 of the leeward bulb 26.

As a result of the shifting of the fluids between the bulbs 26 and 28, the outboard compartment 34 of the bulb 26 will exert a significantly greater buoyant moment on the hull 12 than will the air within the compartment 34 of the bulb 28. This righting moment acts in a counterclockwise direction, as viewed in FIG. 2, and serves to reduce the extent to which the vessel 10 is heeled in the water due to the force of the wind 44. This enhanced righting moment prevents the vessel 10 from heeling excessively and allows the wind to drive the vessel 10 forward with greater force, rather than to merely push it over in the water.

Should the wind come from the opposite direction, the fluids will be transferred between the bulbs 26 and 28 in exactly the opposite direction and with an opposite righting moment than that described with reference to FIG. 2. That is, if the starboard side 18 of the vessel 10 is the windward side and the port side 20 is the leeward side, the hull 12 will begin to heel in a counterclockwise direction from the upright disposition depicted in FIG. 1. When this occurs the weighted roller 58 will travel along the track 60 toward the low or leeward side of the vessel 10, which will be the port side 20. This movement of the weighted roller 58 will cause the transmission shaft 54 to rotate in a clockwise direction, as viewed with reference to FIG. 3, thereby likewise rotating the pinion 52 in a clockwise direction.

Clockwise rotation of the pinion 52 as viewed in FIG. 3 will cause the teeth of the pinion 52 to advance the rack 50 on the outer surface of the coupling tube 36 toward the windward side of the vessel 10, which under such conditions is the starboard side 18. This movement of the coupling tube 26 longitudinally with respect to the surrounding hollow container support tube 24 and laterally relative to the fore and aft plane 14 will flex both of the diaphragms 30 toward the windward starboard side 18 of the vessel 10. This reduces the volume of the outboard compartment 24 of the bulb 26, thereby causing air to flow through the central passageway 38 within the coupling tube 36 and into the outboard compartment 34 of the bulb 28 on the leeward port side 20 of the vessel 10.

Concurrently, water is forced from the inboard compartment 32 of the bulb 28 through the annular passageway 40 and into the inboard compartment 32 of the windward bulb 26. The increased volume of air within the compartment 34 of the bulb 28 causes an increased buoyant force on the vessel 10 to be exerted at the bulb 28. This produces a clockwise righting moment on the hull 12, which reduces the heel of the vessel 10 under such wind conditions.

As previously explained, numerous different keel configurations, bulb configurations and fluid shifting mechanisms are possible according to the improved nautical vessel and buoyancy shifting apparatus of the invention. For example, while the fluid transfer mechanism in the embodiment described is actuated automatically as a result of heeling of the vessel, the system can be designed so that fluid transfer can be initiated manually. Also, numerous different automated inclination sensitive actuating mechanisms can be employed in place of the weighted roller on a track that is described in the embodiment illustrated.

Figure 6:
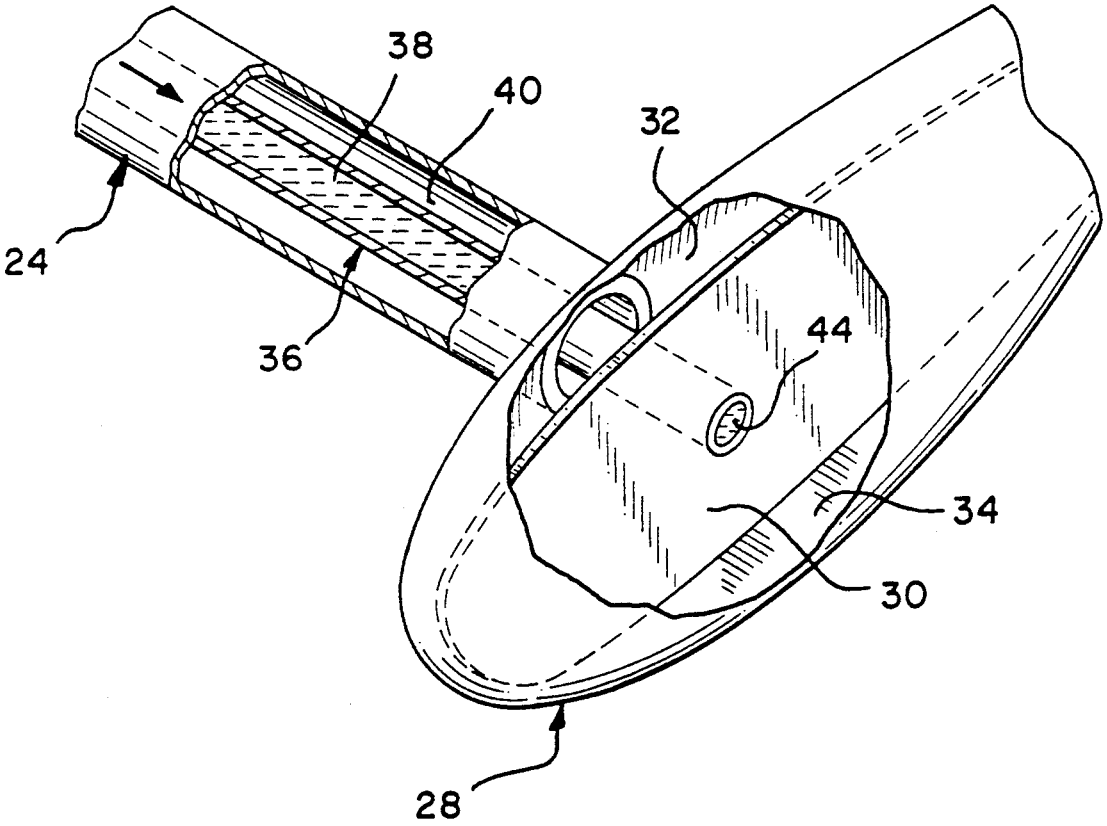
FIG. 6 is a perspective diagram of a portion of an alternative embodiment of the apparatus of FIG. 3.

FIG. 6 illustrates an alternative embodiment of the invention very similar to that of FIG. 3 in which common elements numbered with the same reference numbers. The embodiment of FIG. 6 differs from that of FIG. 3 in that the first fluid that fills the outboard cavities 34 and the internal passageway 38 is the heavier fluid, namely water. The lighter fluid, namely air, fills the inboard cavities 32 and the external passageway 40. In this arrangement water is transferred from the outboard compartment 34 of the leeward bulb to the outboard compartment 34 of the windward bulb, while air is concurrently transferred from the inboard compartment 32 of the windward bulb to the inboard compartment 32 of the leeward bulb. In the embodiment of FIG. 6, as in the embodiment of FIG. 3, a righting moment that opposes heeling of the nautical vessel 10 is obtained. The means for shifting the inner coupling tube 36 relative to the outer hollow container support 24 may be substantially the same as that employed in the embodiment of FIG. 3.

Also, control of the relative volumes of the inboard and outboard compartments need not necessarily employ a mechanical arrangement, such as the rack and pinion gearing illustrated. To the contrary, the same effect can be achieved through the use of different valving arrangements without the necessity for laterally shifting any element, such as the coupling tube 36. Furthermore, the buoyant effects to counter the heeling forces of the wind can be achieved using inflatable and expandable bulbs and only a single buoyant fluid by directing that fluid into which ever bulb is on the leeward side of the vessel. This avoids the use of a plurality of different fluids. Also, while the embodiment of the invention has been depicted and described in conjunction with a monohull vessel, the principles and operating components of the invention can be utilized with multihull vessels as well.

Undoubtedly, numerous other variations and modifications of the invention will become readily apparent to those familiar with marine architecture and sailing vessel design. Accordingly, the scope of the invention should not be construed as limited to the specific embodiment depicted and described herein, but rather is defined in the claims appended hereto.

I claim:

1. Apparatus for reducing the extent of heel of a nautical vessel having a hull extending in a fore and aft direction comprising:

supports coupled to and extending laterally beneath said hull and terminating in extremities laterally equidistant from said hull on opposite sides thereof, hollow bulbs located on said extremities of said supports, fluid tight dividing means in each of said bulbs to divide each of said bulbs in a fore and aft direction into inboard and outboard chambers, means defining a passage between said inboard chambers, means defining a separate passage between said outboard chambers, a first fluid filling said outboard chambers and said passage therebetween, a second fluid having a specific gravity different than that of said first fluid and filling said inboard chambers and said passageway therebetween, fluid transfer means operable to selectively shift a portion of said first fluid from said outboard chamber of one of said bulbs to said outboard chamber of the other of said bulbs and concurrently shift a portion of said second fluid from said inboard chamber of said other of said bulbs to said inboard chamber of said one of said bulbs.

2. Apparatus according to claim 1 wherein said vessel has a keel that extends downward from said hull and said supports extend laterally outwardly from opposite sides of said keel.

3. Apparatus according to claim 1 wherein said fluid tight dividing means are each flexible diaphragms the perimeters of which are sealed to the structure of said bulbs.

4. Apparatus according to claim 3 wherein said means for defining said passage between said outboard chambers is comprised of a hollow inner tube extending between and joined to said diaphragms and apertures in said diaphragms at the extremities of said hollow inner tube, and said means for defining said passage between said inboard chambers is comprised of a hollow outer tube disposed about said hollow inner tube and extending between and joined to said bulbs at openings on said inboard sides thereof, and said fluid transfer means includes means for shifting said inner tube relative to said outer tube responsive to heel of said hull.

5. Apparatus according to claim 4 wherein said means for shifting said inner tube is comprised of a rack defined on the outer surface of said inner tube, a pinion engaged with said rack, a motion transmission shaft extending from said pinion up into said hull, and gravity operated means coupled to said transmission shaft for rotating said transmission shaft in a selected direction responsive to heel of said hull.

6. Apparatus according to claim 5 wherein said hull has a deck and said gravity operated means is comprised of a crank arm extending radially outwardly from said motion transmission shaft, a weighted roller coupled to the radial extremity of said crank arm, and an arcuate track disposed parallel to said deck, whereby said roller rolls to a leeward side of said track when said hull heels, thereby turning said motion transmission shaft in rotation by means of said crank arm.

7. Apparatus according to claim 1 wherein said specific gravity of said second fluid is greater than that of said first fluid, said one of said bulbs is a windward bulb, and said other of said bulbs is a leeward bulb.

8. Apparatus according to claim 1 wherein said first fluid is air and said second fluid is water.

9. In a nautical vessel extending fore and aft and having a hull the improvement comprising:

support means coupled to said hull and projecting laterally outwardly therebeneath on opposite sides thereof a pair of hollow bulbs carried by said support means beneath said hull and on opposite sides thereof, means for dividing each of said bulbs fore and aft into inboard and outboard mutually fluid tight compartments, means for defining a passageway between said inboard compartments, means for defining a separate passageway between said outboard compartments, a first fluid filling said outboard compartments and said passageway therebetween, a second fluid having a specific gravity different than that of said first fluid and filling said inboard compartments and said passageway therebetween, fluid transfer means for concurrently increasing the volume of said inboard compartment of a one of said bulbs while decreasing the volume of said inboard compartment of the other of said bulbs and increasing the volume of said outboard compartment of said other of said bulbs while decreasing the volume of said outboard compartment of said one of said bulbs.

10. A nautical vessel according to claim 9 wherein said vessel has a keel that extends downward from said hull and said support means extend laterally outwardly from opposite sides of said keel.

11. Apparatus according to claim 9 wherein said means for dividing are flexible diaphragms the peripheral edges of which are sealed to said bulbs, and said bulbs have apertures therein in their inboard sides facing each other and said diaphragms have apertures therein aligned with said apertures in said bulbs and said means for defining said passage between said outboard compartments is comprised of a hollow inner tube extending between and sealed to said diaphragms at said apertures therein and said means for defining said passage between said inboard compartments is comprised of a hollow outer tube disposed about said hollow inner tube and extending between and sealed to said bulbs at said openings therein, and said fluid transfer means includes means for shifting said inner tube in a windward direction relative to said outer tube responsive to heel of said vessel.

12. A nautical vessel according to claim 11 wherein said means for shifting said inner tube is comprised of a rack defined on the outer surface of said inner tube, a pinion meshed with said rack, a motion transmission shaft extending from said pinion up into said hull, and gravity operated means coupled to said transmission shaft for rotating said transmission shaft in a selected direction responsive to heel of said hull.

13. A nautical vessel according to claim 12 wherein said hull has a deck and said gravity operated means is comprised of a crank arm extending radially outwardly from said motion transmission shaft, a weighted roller coupled to the radial extremity of said crank arm, and an arcuate track disposed parallel to said deck, whereby said roller rolls to a leeward side of said track, thereby turning said motion transmission shaft in rotation by means of said crank arm.

14. A nautical vessel according to claim 9 wherein said second fluid has a higher specific gravity than said first fluid, said one bulb is a windward bulb and said other bulb is a leeward bulb.

15. A nautical vessel according to claim 14 wherein said first fluid is air and said second fluid is water.

16. In a floating nautical vessel having a hull symmetrical about a fore and aft plane the improvement comprising:

hollow container support means coupled to said hull and extending laterally therebeneath on both sides thereof, a pair of hollow containers carried by said container support means beneath and on opposite sides of said hull, fluid tight dividing means in each of said containers that divide each of said containers in a fore and aft direction and which define an inboard cavity and an outboard cavity in each container, rigid, hollow coupling means disposed for reciprocal movement within said hollow support means and defining an internal flow passageway therewithin in open communication between both of said outboard cavities and an external flow passageway outside of said coupling means and within said hollow support means, wherein said inboard cavities are in open communication with each other through said external flow passageway, and said inboard cavities and said external flow passageway are sealed in fluid tight isolation from said outboard cavities and said internal flow passageway, a first fluid that fills said outboard cavities and said internal passageway, a second fluid that fills said inboard cavities and said external passageway and which has a different specific gravity than that of said first fluid, inclination sensing means connected to said hollow coupling means to move said hollow coupling means laterally toward one of said containers in response to heeling of said hull in a first lateral direction and laterally toward the other of said containers in response to heeling of said hull in an opposite lateral direction, thereby adjusting the volumes of said cavities to force said fluids in opposite directions through their respective passageways so that they exert a righting moment on said hull.

17. A nautical vessel according to claim 16 wherein said vessel has a keel that extends downward from said hull and said container support means extends laterally outwardly from opposite sides of said keel.

18. A nautical vessel according to claim 16 wherein said fluid tight dividing means are flexible diaphragms the perimeters of which are sealed to and longitudinally divide each of said containers in a fore and aft direction and said containers have apertures therein in their inboard sides facing each other and said diaphragms have apertures therein aligned with said apertures in said containers and said rigid hollow coupling means is comprised of:

a hollow inner tube extending between and sealed to said diaphragms at said apertures therein, and said hollow support means is comprised of:

a hollow outer tube disposed about said hollow inner tube and extending between and sealed to said containers at said apertures therein, and said inclination sensing means includes means for shifting said inner tube longitudinally relative to said outer tube.

19. A nautical vessel according to claim 18 wherein said means for shifting said inner tube is comprised of a rack defined on the outer surface of said inner tube, a pinion meshed with said rack, a motion transmission shaft extending from said pinion up into said hull, and gravity operated means coupled to said transmission shaft for rotating said transmission shaft in a selected direction responsive to heel of said hull.

20. A nautical vessel according to claim 16 wherein said first fluid is denser than said second fluid and said inclination sensing means shifts said rigid hollow coupling means relative to said hollow container support means and toward said one of said containers and said one of said containers is located furthest to leeward.

21. Apparatus for reducing the extent of heel of a nautical vessel having a hull extending in a force and aft direction comprising:

supports coupled to and extending laterally beneath said hull on opposite sides thereof, hollow enclosed, confining bulbs both capable of being alternatively windward and leeward bulbs, depending upon wind direction relative to said hull, located on said supports, means defining a passage between said bulbs, a buoyant fluid enclosed and confined within said bulbs and said passage therebetween, fluid transfer means to operable to selectively shift a portion of said buoyant fluid from a windward one of said bulbs to the other leeward one of said bulbs, while isolating said buoyant fluid within said bulbs and said passage therebetween.

* * * * *